United States Patent [19]

Deutsch

[11] Patent Number: 4,579,032

[45] Date of Patent: Apr. 1, 1986

[54] COMPUTATION TIME REDUCTION IN A POLYPHONIC TONE SYNTHESIZER

[75] Inventor: Ralph Deutsch, Sherman Oaks, Calif.

[73] Assignee: Kawai Musical Instrument Mfg. Co., Ltd, Hamamatsu, Japan

[21] Appl. No.: 649,240

[22] Filed: Sep. 10, 1984

[51] Int. Cl.[4] ..... G10H 1/08; G10H 7/00

[52] U.S. Cl. ..... 84/1.22; 84/1.01; 84/1.23

[58] Field of Search ..... 84/1.01, 1.03, 1.22, 84/1.23

[56] References Cited

U.S. PATENT DOCUMENTS

| | | | |
|---|---|---|---|
| 3,763,364 | 10/1973 | Deutsch et al. | 84/1.03 X |
| 4,249,448 | 2/1981 | Deutsch et al. | 84/1.23 |
| 4,286,491 | 9/1981 | Deutsch | 84/1.01 |
| 4,453,441 | 6/1984 | Deutsch | 84/1.22 |
| 4,467,688 | 8/1984 | Deutsch et al. | 84/1.01 |
| 4,502,360 | 3/1985 | Deutsch | 84/1.23 |
| 4,513,651 | 4/1985 | Deutsch et al. | 84/1.22 |
| 4,526,081 | 7/1985 | Deutsch | 84/1.23 |

*Primary Examiner*—Stanley J. Witkowski

*Attorney, Agent, or Firm*—Ralph Deutsch

[57] ABSTRACT

A keyboard operated electronic musical instrument is disclosed which has a number of tone generators that are assigned to actuated keyswitches. Musical tones are produced by computing a master data set which defines the data points for a period of the musical waveshape. The computation uses a preselected set of harmonic coefficients. The time required to complete a master data set computation is reduced by dividing the set of harmonic coefficients into a number of subsets of coefficients. The harmonic coefficients are combined by a combination of a reverse addressing and complementing in a logic that decreases the required number of computation time intervals.

20 Claims, 6 Drawing Figures

COMPUTATION TIME REDUCTION IN A POLYPHONIC TONE SYNTHESIZER

BACKGROUND OF THE INVENTION

1. Field of the Invention

This invention relates to electronic tone synthesis and in particular is concerned with reducing the time required to compute waveshapes.

2. Description of the Prior Art

In a tone generator of the type described in U.S. Pat. No. 4,085,644 entitled "Polyphonic Tone Synthesizer" a method is described for creating the tonal effect of a sliding formant filter. The rate at which the generated musical waveform can be varied as a function of time is limited by the length of time required to complete a computation cycle during which a master data set defining the instantaneous musical tone is computed and by the length of time required to copy the generated master data set into note registers contained in each of a number of tone generators.

The most obvious way to reduce the time allocated to a computation cycle is to simply increase the frequency of the master clock which provides the timing signals for the system's logical system operations. There are practical as well as economic limitations imposed on the speed, or frequency, of the master clock. Since the cost of implementing a musical tone generation system with microelectronic circuitry rises with an increase in the computation speed, it is desirable to achieve a decreased length of the computation cycle without increasing the speed of the master clock.

In U.S. Pat. No. 4,085,644 a procedure is described which reduces the computation cycle by one-half of the nominal time. This procedure entailed computing only 32 data words instead of the 64 data words nominally required to define a master data set corresponding to a musical waveshape having a maximum of 32 harmonics. This reduction of one-half in the number of data points required to be computed for the master data set is accomplished by generating the master data set having a prespecified symmetry of data points. The symmetry is obtained by using either only trigonometric sine (or equivalent odd symmetric orthogonal functions) terms or only cosine (or equivalent even symmetric orthogonal function) terms in the Fourier transform algorithm used to calculate the master data set of points. The second 32 data points required by the note registers can be obtained by reading the data stored in the main register forward and then backward. In the backward, or reverse addressing, mode a 2's complement operation is applied to the addressed master data set words if the trigonometric sine terms, or odd symmetric calculations, were used to generate the master data set. No change in the addressed master data set values is required if the trigonometric cosine terms, or even symmetric calculations, were used to generate the master data set.

In U.S. Pat. No. 4,249,448 entitled "Even-Odd Symmetric Computation In A Polyphonic Tone Synthesizer" a procedure is described for reducing the number of data words required to be computed for the master data set to 16 without a reduction of the 32 maximum harmonics capability for the generated musical waveshapes. The reduction in the size of the master data set is accomplished by decomposing the master data set into two components. The first component is generated using only the odd numbered harmonic coefficients and the second component is generated using only the even numbered harmonic components. The component master data sets are stored in two memories. During a transfer cycle, the required full cycle waveshape data is created by forward and backward addressing of the data stored in the two memories. The data addressed out is complemented and added in a specified manner so that the required full cycle waveshape set of points is created from 16 master data set points instead of directly computing the full 64 data points required by the note registers. In the disclosed system, the time required for the generation of the master data set during a computation cycle is reduced by a factor of four corresponding to the calculation of only 16 data points instead of the nominal requirement of 64 data points.

The present invention provides a novel implementation for reducing the time required to compute a master data set and is independent of any symmetry economics introduced in the computations.

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted into musical waveshapes. A sequence of computation cycles is implemented during each of which a master data set is created. The master data set comprises a set of data points which define a period of a musical waveshape. The master data set is computed using a set of stored harmonic coefficients. In one embodiment the harmonic coefficients are divided into two equal subsets. The first subset comprises the first half of the set of coefficients and the second half comprise the second half of the set of coefficients but are used in the reversed order. A harmonic combining means is employed which performs a 2's complement logic operating on the harmonic coefficient in the second subset which are then added with corresponding elements of the first subset to produce a combined set of coefficients which is less in number than the complete set of harmonic coefficients. By using the combined set of coefficients the length of time required for a computation cycle is reduced.

A second embodiment is described in which the set of harmonic coefficients is divided into four subset of harmonic coefficients. A logic is described whereby these subsets are combined in a disclosed fashion such that the required computation cycle time is reduced by a factor of four.

Following each computation cycle, a transfer cycle is initiated during which the master data set is transferred to members of a multiplicity of tone generators and stored in a note register which is an element of each of the individual tone generators. The output tone generation continues uninterrupted during the computation and transfer cycles.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed toward a system for reducing the computation time in a digital tone generation system of the type in which waveshape points are computed from a preselected set of harmonic coefficients. A tone generation system of this category is described in detail in U.S. Pat. No. 4,085,644 entitled "Polyphonic Tone Synthesizer." This patent is hereby incorporated by reference. In the following description all elements of the system which are described in the referenced patent are identified by two digit numbers which correspond to the same numbered elements appearing in the referenced patent.

Figure 1:
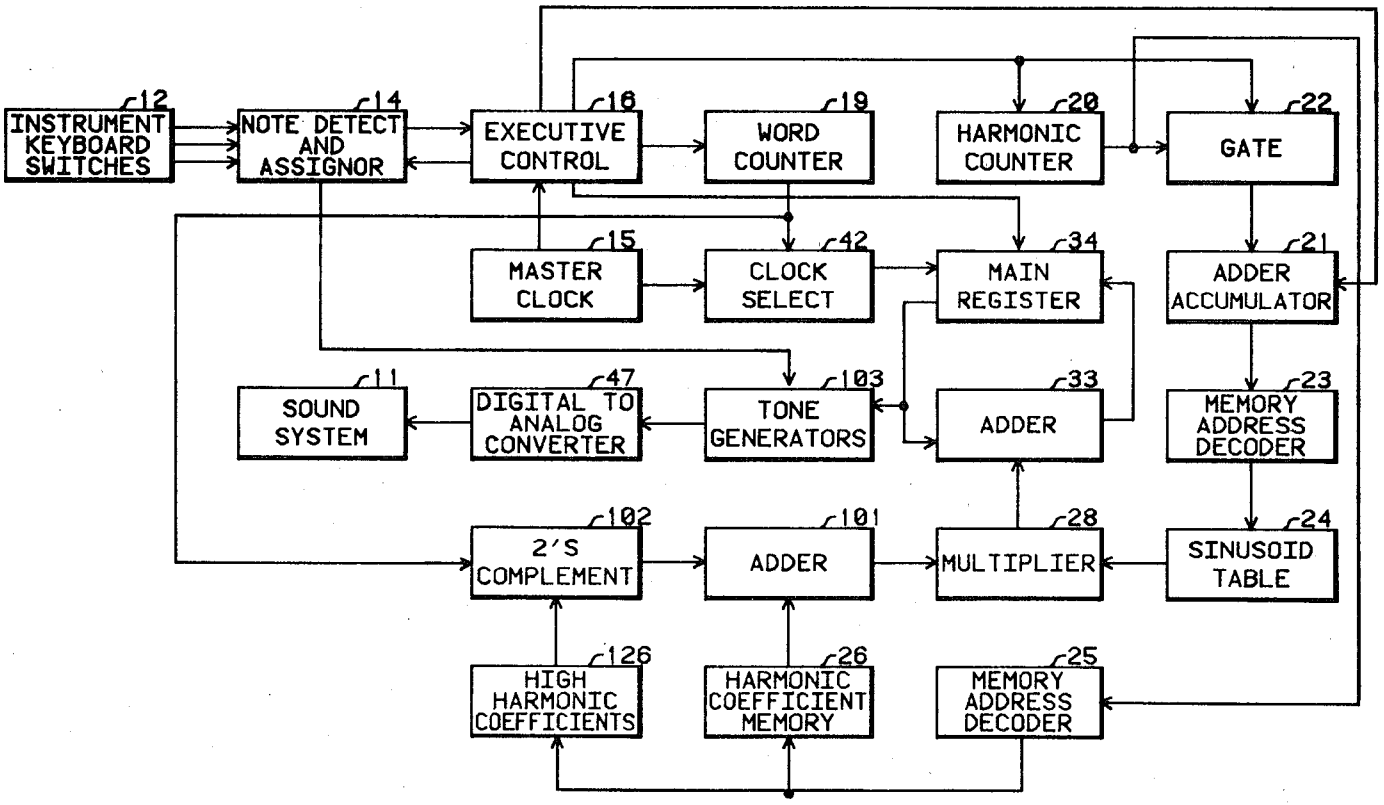
FIG. 1 is a schematic diagram of an embodiment of the invention.

FIG. 1 shows an embodiment of the present invention which is described as a modification and adjunct to the system described in the referenced patent U.S. Pat. No. 4,085,644. As described in the referenced patent, the Polyphonic Tone Synthesizer includes an array of instrument keyboard switches 12. If one or more of the keyboard switches has a switch status change and is actuated ("on" switch position), the note detect and assignor 14 encodes the detected keyboard switch having the status change to an actuated state and stores the corresponding note information for the actuated keyswitches. A tone generator, contained in the system block labeled tone generators 103, is assigned to each actuated keyswitch using information generated by the note detect and assignor 14.

A suitable configuration for a note detect and assignor subsystem is described in U.S. Pat. No. 4,022,098. This patent is hereby incorporated by reference.

When one or more keyswitches have been actuated the executive control 16 initiates a repetitive sequence of computation cycles. During each computation cycle, a master data set comprising 64 data words is computed. The 64 data words in a master data set correspond to the amplitudes of 64 equally spaced points of one cycle of a waveform for a musical tone. The general rule is that the maximum number of harmonics in the audible tone spectra of the generated musical tone is no more than one-half of the number of data points in one complete waveshape period. Therefore, a master data set comprising 64 data words corresponds to a musical waveshape having a maximum of 32 harmonics.

As described in the referenced U.S. Pat. No. 4,085,644 it is desirable to be able to continuously recompute and store the master data set having a repetitive sequence of computation cycles and to load this data into note registers while the keyswitches remain actuated, or depressed, on the keyboards. There is a note register associated with each tone generator contained in the system block labeled tone generators 103.

In the manner described in the referenced U.S. Pat. No. 4,085,644 the harmonic counter 20 is initialized to its minimal, or zero, count state at the start of each computation cycle. Each time that the word counter is incremented by the executive control 16 so that it returns to its minimal, or zero, count state because of its modulo counting implementation, a signal is generated by the executive control 16 which increments the count state of the harmonic counter 20. The word counter 19 is implemented to count modulo 64 which is the number of data words comprising the master data set. The harmonic counter 20 is implemented to count modulo 16. This number corresponds to one-half of the maximum number of harmonics consistent with a master data set comprising 64 data words. It is noted that in the computing system described in the referenced U.S. Pat. No. 4,085,644 the harmonic counter 20 is implemented to count modulo 32 which corresponds to the maximum number of harmonics consistent with a master data set comprising 64 data words.

At the start of each computation cycle, the accumulator in the adder-accumulator 21 is initialized to a zero value by the executive control 16. Each time that the word counter is incremented, the adder-accumulator 21 adds the current count state of the harmonic counter 20 to the sum contained in the accumulator. This addition is implemented to be modulo 64.

The content of the accumulator in the adder-accumulator 21 is used by the memory address decoder to access trigonometric sinusoid values from the sinusoid table 24. The sinusoid table 24 is advantageously implemented as a read only memory storing values of the trigonometric function sin $(2\pi\phi/64)$ for $0 \leqq \phi \leqq 64$ at intervals of D. D is a table resolution constant.

The memory address decoder 25 is used to simultaneously read out harmonic coefficient values stored in the harmonic coefficient memory 26 and the high harmonic coefficients 126.

The harmonic coefficient memory 26 stores the harmonic coefficients corresponding to the 16 harmonic numbers in the range of 1,2, . . . , 16. The high harmonic coefficients 126 is an addressable memory storing the harmonic coefficients 31 to 16. These are stored in a reverse order such that when the harmonic coefficient corresponding to the harmonic number 1 is read out of the harmonic coefficient memory 26 in response to the output of the memory address decoder 25, the harmonic coefficient corresponding to the harmonic number 31 is read out of the high harmonic coefficients 126. Because a harmonic coefficient corresponding to the harmonic number 16 is contained in both the harmonic coefficient memories, this harmonic coefficient can be stored with one-half of its value in each memory. Other fractions can be used such as storing the full harmonic coefficient in one memory and a zero value in the other memory.

The 2's complement 102 will perform a 2's complement binary number operation on the harmonic coefficients read out of the high harmonic coefficients if the LSB (least significant bit) of the current state of the word counter 19 is a binary "1". If the state of the LSB is a binary "0", then the harmonic coefficient read out of the high harmonic coefficients 126 is transferred unaltered to the adder 101. A 2's complement operation is equivalent to changing the algebraic sign of a harmonic number to its opposite algebraic sign.

The harmonic coefficients furnished by the 2's complement 102 and those read out of the harmonic coefficient memory 26 are summed in the adder 101 and the summed value is provided to the multiplier 28. The multiplier generates the product value of the trigonometric data value read out from the sinusoid table 24 and the value of the summed data provided by the adder 101. The generated product value formed by the multiplier 28 is furnished as one input to the adder 33.

The contents of the main register 34 and are initialized to a zero value at the start of each computation cycle. Each time that the word counter 19 is incremented, the content of the main register 34, at an address corresponding to the count state of the word counter 19, is read out and furnished as an input to the adder 33. The sum of the inputs to the adder 33 are stored in the main register 34 at a memory location equal, or corresponding, to the count state of the word counter 19. After the word counter 19 has been cycled for 16 complete cycles of 64 counts, the main register 34 will contain a master data set which comprises a complete period of musical waveshape having a spectral function determined by the harmonic coefficients stored in the harmonic coefficient memory 26 and the high harmonic coefficients 126.

Following each computation cycle in the repetitive sequence of computation cycles, a transfer cycle is initiated and executed. During a transfer cycle, in a manner described in the referenced U.S. Pat. No. 4,085,644, the master data set stored in the main register 34 is transferred into the note registers which are a component of each of the tone generators contained in the system block labeled tone generators 103.

The master data set stored in each of the note registers is sequentially and repetitively read out at a memory advance rate corresponding to the fundamental frequency associated with an actuated keyswitch to which a tone generator has been assigned. The read out data is connected into an analog signal by means of the digital-to-analog converter 47. The resultant analog signal is transformed into an audible musical sound by means of the sound system 11. The sound system 11 contains a conventional amplifier and speaker combination for producing audible tones.

An explanation of the system's capability of reducing by one-half the normal number of computational operations is found by an appropriate reformulation of the discrete Fourier transform that is used to compute the master data set. As described in the referenced U.S. Pat. No. 4,085,644, if only the trigonometric sine functions are used, the master data set words are computed from the relation $$z_n = \sum_{q=1}^{32} c_q \sin(2\pi nq/64);\ n = 1,2,\ldots,64 \qquad \text{Eq. 1}$$

It is noted that while the word index n has the decimal range of values from 1 to 64, the corresponding binary states of the word counter 19 run from binary 000 000 to 111 111 (0 to 63 expressed as equivalent decimal numbers).

Eq. 1 can be written in the composite form $$z_n = \sum_{q=1}^{16} c_q \sin(\pi nq/32) + B_n \qquad \text{Eq. 2}$$

where $$B_n = \sum_{q=16}^{32} c_q \sin(\pi nq/32) + B_n \qquad \text{Eq. 3}$$

In this composite form it is assumed that the value of the 16th harmonic coefficient $c_{16}$ has been apportioned between the two composite summations of Eq. 2. If the change of variable $k=32-q$ is made in Eq. 3 the form of the component $B_n$ can be written as follows:

$$\begin{aligned} B_n &= \sum_{k=16}^{0} c_{32-k} \sin\pi n(32-k/32) \qquad \text{Eq. 4} \\ &= \sum_{k=16}^{0} c_{32-k} [\sin\pi n \cos\pi nk/32 - \cos\pi n \sin\pi nk/32] \\ &= -\sum_{k=16}^{0} (-1)^n c_{32-k} \sin\pi nk/32 \end{aligned}$$

Combine Eq. 4 with Eq. 2 to obtain $$\begin{aligned} z_n &= \sum_{q=1}^{16} c_q \sin(\pi nq/32) \qquad \text{Eq. 5} \\ &- \sum_{k=16}^{0} (-1)^n c_{32-k} \sin\pi nk/32 \\ &= \sum_{q=1}^{16} [c_q - (-1)^n c_{32-q}] \sin\pi nq/32 \end{aligned}$$

The system shown in FIG. 1 implements Eq. 5 which indicates the manner in which the harmonic coefficients should be stored and read out of the harmonic coefficient memory 26 and the high harmonic coefficients 126. The 2's complement 102 evaluates the term $(-1)^n c_{32-q}$ of Eq. 5. Notice that the original summation of 32 values of the harmonic index q in Eq. 1 has been reduced to the summation of 16 values in the equivalent form of Eq. 5.

An examination of Eq. 5 or Eq. 1 shows that the 32nd harmonic contribution is missing from the result of the discrete Fourier transform. This missing maximum harmonic term is not a special characteristic property of the inventive system but is a natural result of a computation of the master data set from the basic form of the discrete Fourier transform defined in Eq. 1. One method of obtaining the full 32 harmonics is to store the trigonometric sine values $\sin[2\pi(2\phi-1)/128]$ for values of $\phi=1,2,\ldots,64$ in the sinusoid table 24 instead of the sine values $\sin[2\pi\phi/64]$ for $\phi=1,2,\ldots,64$. The new trigonometric values stored in the sinusoid table 24 are read out by means of the memory address decoder 23 in response to the content of the adder accumulator 21. The content of the address-accumulator is the value nq where n is the present word number of the master data set and q is the present harmonic number.

If the fractional point values $\sin[2\pi(2\phi-1)/128]$ are stored in the sinusoid table 24, then the harmonic coefficients for the harmonic numbers 32 to 17, in this reverse order, are stored in the high harmonic coefficients 126. In this configuration the repeated value of the harmonic coefficient for the 16th harmonic does not occur.

An analogous for to that of Eq. 5 can be formulayed and implemented for the case in which the master data set points $z_n$ are computed with an even symmetry. This is done by using stored values of the cosine trigonometric functions in the sinusoid table 24.

Figure 2:
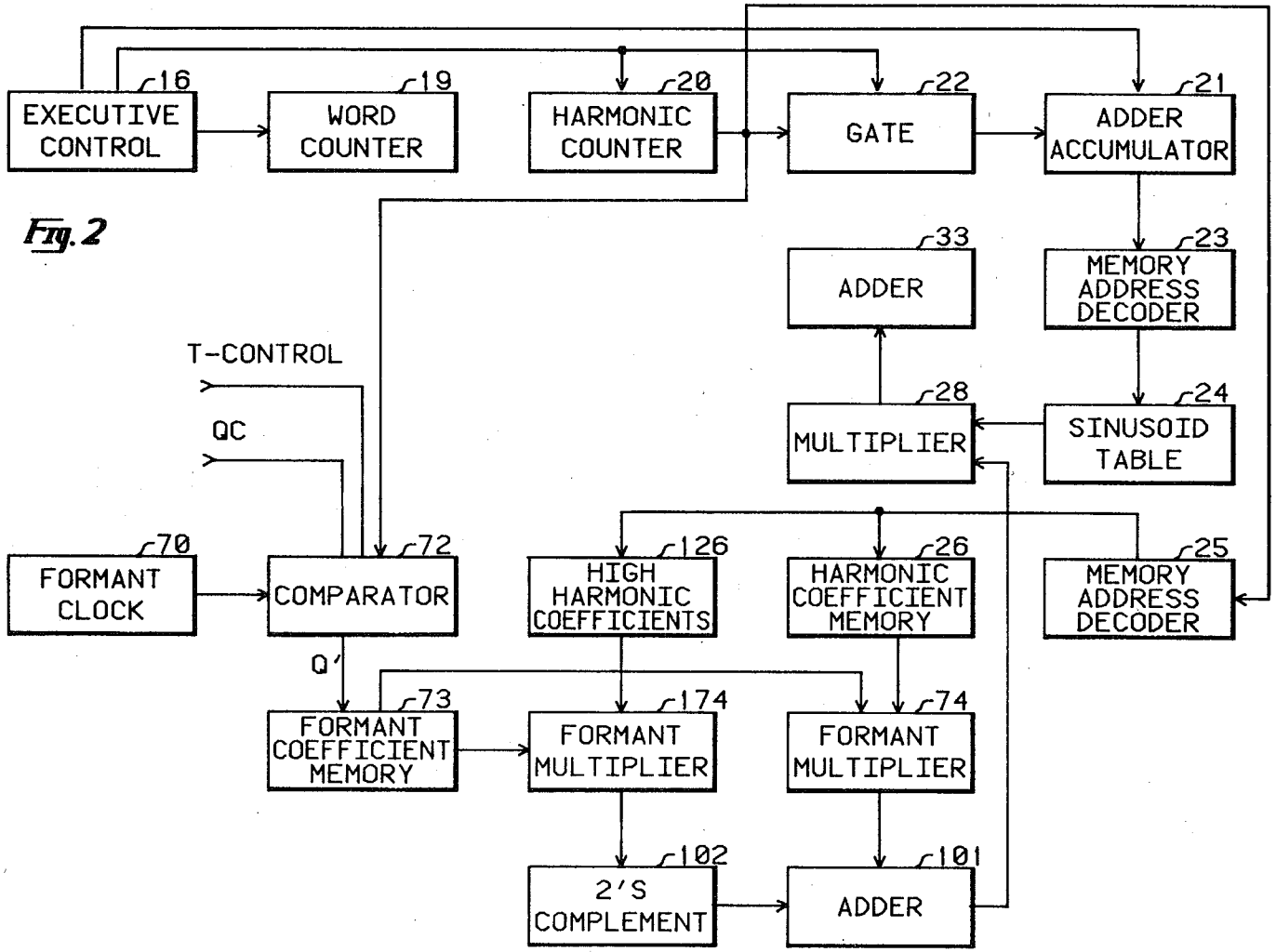
FIG. 2 is a schematic diagram of the sliding formant filter subsystem.

FIG. 2 shows a subsystem for incorporating the effect of a sliding formant with the present invention. The sliding formant subsystem is essentially similar to the sliding formant system shown in FIG. 5 of the referenced U.S. Pat. No. 4,085,644. An additional formant multiplier 174 is used because a separate formant multiplier is required for the harmonic coefficient values simultaneously read out of the harmonic coefficient memory 26 and the high harmonic coefficient 126.

The comparator 72 receives the current value of the harmonic number q which is the count state of the harmonic counter 20. The preselected constant QC is furnished as a second input signal value to the comparator 72. QC is equal to a preselected harmonic number that determines the effective cut-off frequency for the formant filter. The formant clock 70 is a variable frequency clock whose frequency is selected to determine the speed, or rate, at which the cut-off harmonic formant filter is changed. The output of the formant clock 70 is a time varying parameter u. The comparator 72 compares the value of the sum u+q with the preselected value of QC. If q+u is less than or equal to QC, then a signal Q'=1 is transmitted to the formant coefficient memory 73. If the comparator 72 finds, at some time, that q+u is greater than the preselected cut-off value QC, then the values $Q'=q+u-QC$ is transmitted to the formant coefficient memory 73.

The value of Q' transmitted to the formant coefficient memory 73 is used to address out two attenuation factors, or formant coefficients, stored in the formant coefficient memory 73. The first value corresponds to the present harmonic number q and is furnished as a multiplier input value to the formant multiplier 74. The second formant coefficient read out of the formant coefficient memory corresponds to the present value of 32−q and is furnished as a multiplier input value to the formant multiplier 174.

The formant multiplier 74 forms the product of the harmonic coefficient read out of the harmonic coefficient memory 26 with a formant coefficient and the product value is furnished as an input to the adder 101. The formant multiplier 174 forms the product value of the harmonic coefficient read out of the high harmonic coefficients 126 with a formant coefficient and the product value is furnished as an input to the 2's complement 102.

The T signal is a preselected control signal provided as an input to the comparator 72. If T has the binary logic state T="1", then the comparator acts in the manner previously described which causes the formant subsystem to function effectively as a sliding low-pass harmonic filter. If T has the binary logic state T="0", then the comparator 72 transmits the value Q'=1 to the formant coefficient memory 73 if q+u is greater than or equal to the preselected value of QC. If q+u is less than the preselected value of QC, then the value $Q'=QC-(q+u)$ is transmitted to the formant coefficient memory 73. The net result is that the formant subsystem functions effectively as sliding high-pass harmonic filter.

The present invention is also applicable to other tone generation systems that embody a discrete Fourier transform implementation to compute musical waveshape points from a given set of harmonic coefficients. A tone generation system of this generic type is described in U.S. Pat. No. 3,809,786 entitled "Computor Organ." This patent is hereby incorporated by reference.

Figure 3:
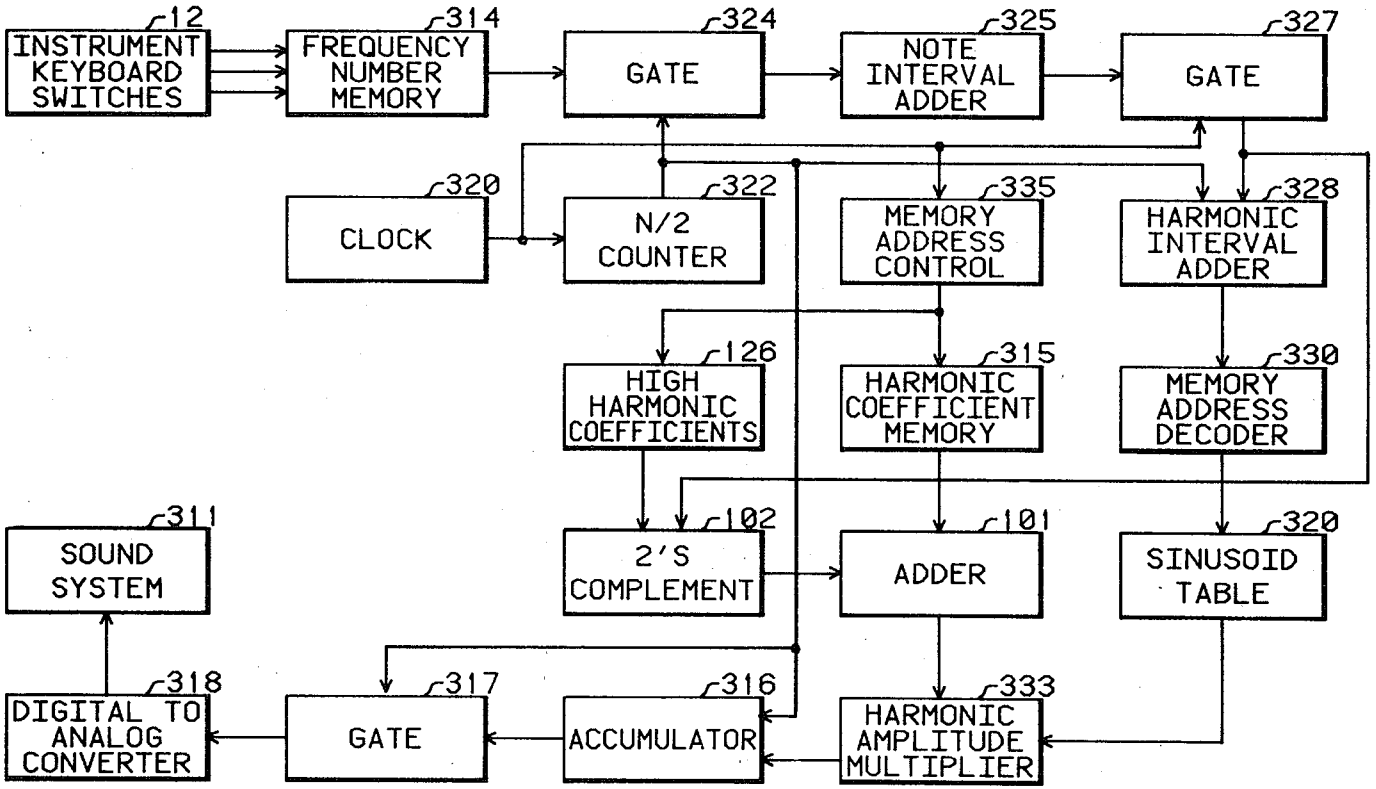
FIG. 3 is an embodiment of the invention incorporated into a Computor Organ.

FIG. 3 illustrates an embodiment of the present invention incorporated into the tone generation system described in the referenced U.S. Pat. No. 3,809,786. The system blocks in FIG. 3 which have numbers in the "300" range are numbered to be 300 added to the block numbers shown in FIG. 1 of U.S. Pat. No. 3,809,786.

A closure of a keyswitch contained in the block labeled instrument keyswitches 12 causes a corresponding frequency number to be accessed out of the frequency number memory 314. The frequency number transferred via gate 324 is repetitively added to the contents of the note interval adder 325 at a rate determined by the changes in the count state of the N/2 counter 322. The content of the note interval adder 325 specifies the sample point on a waveshape that is to be computed. For each such sample point, the amplitudes of a number of harmonic components are individually calculated by multiplying the harmonic components furnished by the adder 101 with trigonometric sinusoid values read out of the sinusoid table 320. This multiplication is performed by the harmonic multiplier 333. The resultant harmonic component amplitudes are summed algebraically by means of the accumulator 316 to obtain the net amplitude value at the waveshape sample point corresponding to the content of the note interval adder 325. The details of this calculation are described in the referenced U.S. Pat. No. 3,809,786.

The waveshape sample points contained in the accumulator 316 are converted into analog signals by means of the digital-to-analog converter 318. The output analog signal is furnished to the sound system 111 which transforms the signal into an audible musical tone.

The memory address control 335 simultaneously addresses out harmonic coefficients stored in the harmonic coefficient memory 315 and the high harmonic coefficients 126. The harmonic coefficient memory 315 stores the harmonic coefficients corresponding to the sequence of harmonic numbers 32,31, . . . , 17 stored in the decreasing order of the harmonic numbers. The sinusoid table 320 stores the fractional address sine values $\sin[2\pi(2\phi-1)/128]$ so that tones with the full range of 32 harmonics can be generated.

The 2's complement 102 uses the lowest bit of the six most significant bits of the content of the note interval adder to determine if the input data from the high harmonic coefficients 126 should have a 2's complement operation. This logic is analogous to the complementing logic shown in FIG. 1 and previously described.

Figure 4:
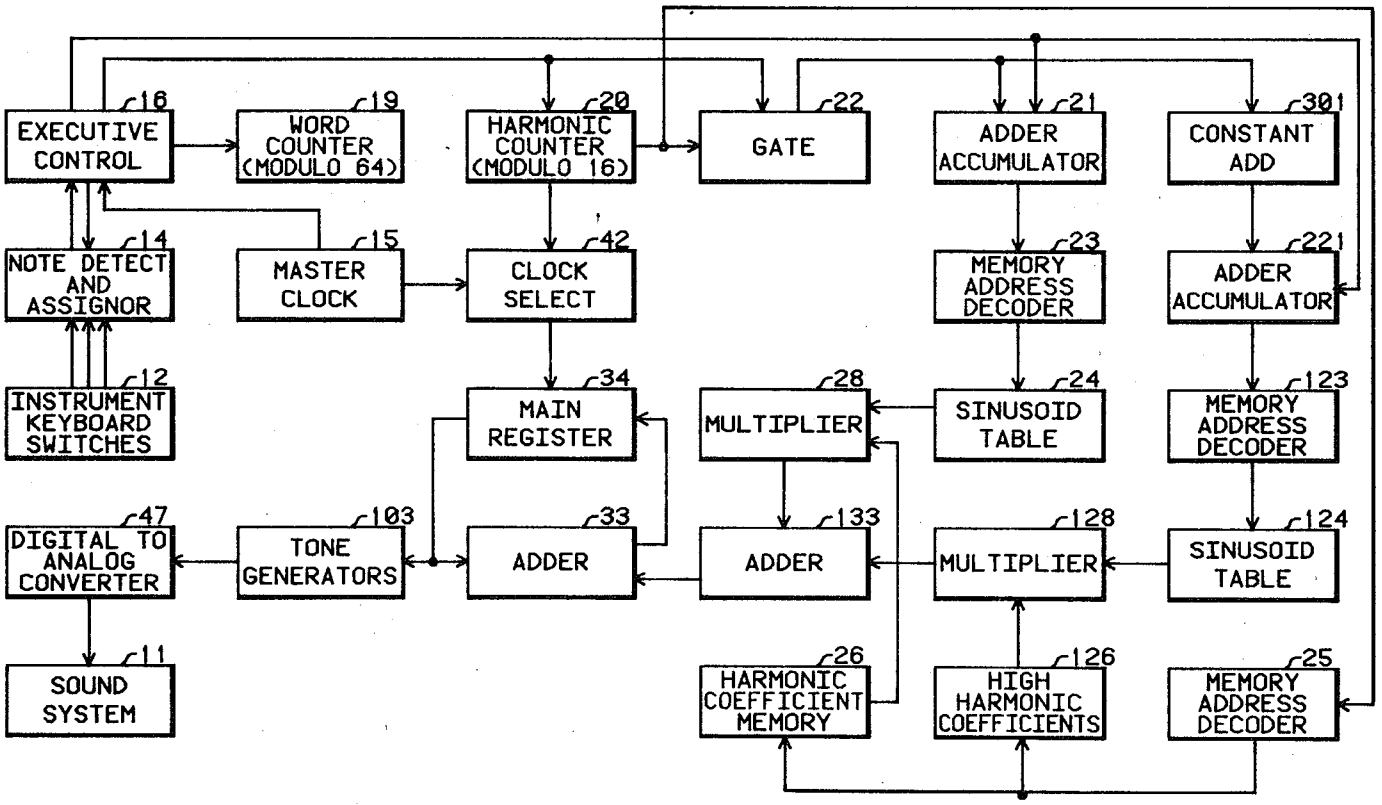
FIG. 4 is a schematic diagram of a parallel computation arrangement.

FIG. 4 illustrates a system arrangement in which parallel computation logic operations are used to reduce the number of operations required to compute a master data and thereby reduce the time required for a computation cycle for a tone generation system described in the previously referenced U.S. Pat. No. 4,085,644.

The first parallel computation subsystem uses the adder-accumulator 21, memory address decoder 23, sinusoid table 24, multiplier 28 and the harmonic coefficient memory 26 in the manner described in the referenced U.S. Pat. No. 4,085,644. The harmonic coefficients corresponding to the sequence of harmonic numbers 1,2, . . . , 16 are stored in the harmonic coefficient memory 26.

The second parallel computation subsystem uses the constant add 301, adder accumulator 221, memory address decoder 123, sinusoid table 124, multiplier 128, and the high harmonic coefficients 126. The harmonic coefficients corresponding to the reverse sequence of harmonic numbers 32,31, . . . , 17 are stored in the high harmonic coefficients 126.

The constant add 310 adds a constant value of 16 the count state of the harmonic counter 20 before furnishing the value to the adder-accumulator 221. In this configuration, the harmonic counter 20 is implemented to count modulo 16.

The sinusoid tables 24 and 124 both store the same values of the trigonometric sine function $\sin(2\pi\phi/64)$ as previously described for the system configuration shown in FIG. 1.

The data point values produced by the two parallel computing subsystems are summed by means of the adder 133. The summed value is furnished to the adder 33 which acts in the manner previously described for the system configuration shown in FIG. 1 to aid in the computation of the master data set values which are stored in the main register 34.

It is an obvious extension of the above parallel computation configuration to provide additional parallel computing subsystems to obtain further reductions in the number of computational operations required to compute a master data set and thereby reduced the time that must be allocated to complete a computation cycle.

Figure 5:
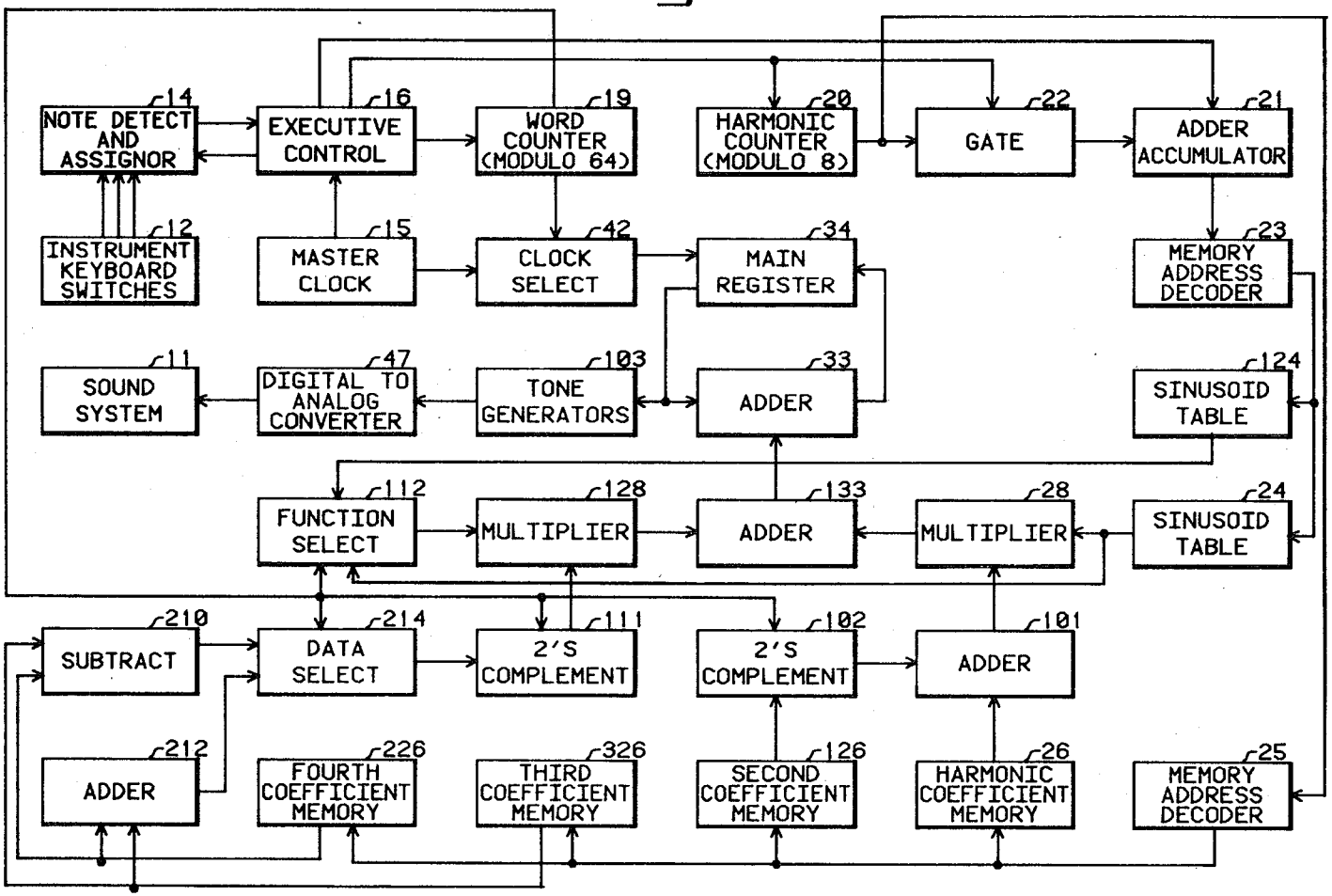
FIG. 5 is an alternative embodiment employing parallel computation.

FIG. 5 is a schematic diagram illustrating another alternative embodiment of the present invention. In this embodiment a harmonic decomposition is utilized to obtain a reduction of a factor of four for the time required to compute a master data set without restricting the maximum number of harmonic coefficients.

The system shown in FIG. 5 implements a Fourier transform decomposition of summation terms which can be developed in the following manner. Eq. 1 for the data values $Z_n$ in the master data set can be written in the decomposition form $$z_n = E_n + F_n + G_n + H_n;\ n = 1,2,\ldots,64 \qquad \text{Eq. 6}$$

where $$E_n = \sum_{q=1}^{8} c_q \sin \pi nq/32 \qquad \text{Eq. 7}$$

$$F_n = \sum_{q=8}^{16} c_q \sin \pi nq/32 \qquad \text{Eq. 8}$$

$$G_n = \sum_{q=16}^{24} c_q \sin \pi nq/32 \qquad \text{Eq. 9}$$

$$H_n = \sum_{q=24}^{32} c_q \sin \pi nq/32 \qquad \text{Eq. 10}$$

Make the change of variable $k=32-q$ in Eq. 10 to obtain $$\begin{aligned} H_n &= \sum_{k=8}^{0} c_{32-k} \sin[\pi n(32-k)/32] \qquad \text{Eq. 11} \\ &= \sum_{k=8}^{0} c_{32-k} [\sin \pi n \cos \pi nk/32 - \cos \pi n \sin \pi nk/32] \\ &= -(-1)^n \sum_{k=8}^{0} c_{32-k} \sin \pi nk/32 \end{aligned}$$

Eq. 11 is a result that is similar to the formulation previously developed for Eq. 4.

The first computation channel shown in FIG. 5 implements the computation of the decomposition components $E_n$ and $H_n$ for the master data set points $z_n$. This channel comprises the memory address decoder 25, harmonic coefficient memory 26, second coefficient memory 126, 2's complement 102, multiplier 28, adder 133, adder 33, and sinusoid table 24.

The harmonic coefficient memory 26 stores the harmonic coefficients corresponding to the harmonic number sequence 1,2, . . . , 8. For the same reasons previously discussed for the system shown in FIG. 1, the harmonic coefficient $c_8$ for the eighth harmonic is stored in two harmonic coefficient memories. Thus one choice is to store $c_8/2$ in the harmonic coefficient memory 26 and in the third coefficient memory 326. The second coefficient memory 126 stores the harmonic coefficients corresponding to the harmonic sequence 32,31, . . . , 24. These harmonic coefficients are stored in the indicated reverse order of the corresponding harmonic numbers. For the same reasons discussed for the eighth harmonic coefficient $c_8$, the harmonic coefficient $c_{24}$, corresponding to the 24th harmonic number, is stored with ½ of its value as $c_{24}/2$.

The second computation channel shown in FIG. 5 implements the computation of the decomposition components $F_n$ and $G_n$. The second computation channel comprises the memory address decoder 25, third coefficient memory 326, fourth coefficient memory 226, adder 212, subtract 210, data select 214, 2's complement 111, function select 112, multiplier 128, adder 133, adder 33, and sinusoid table 124.

The first computation channel computes the sum of $E_n$ and $H_n$ in a manner which is exactly the same as that in which the decomposition summation terms were computed in the system shown in FIG. 1 and previously described. For the system shown in FIG. 5, the harmonic counter 20 is implemented to count modulo 8.

Eq. 8 for the decomposition terms $F_n$ can be written in the following form by making the change of variable $k=16-q$:

$$\begin{aligned} F_n &= \sum_{k=8}^{0} c_{16-k} \sin[\pi n(16-k)/32] \qquad \text{Eq. 12} \\ &= \sum_{k=8}^{0} c_{16-k} (\sin \pi n/2 \cos \pi nk/32 - \cos \pi n/2 \sin \pi nk/32) \end{aligned}$$

Similarly the change of variable $k=q-16$ in Eq. 16 leads to the form $$\begin{aligned} G_n &= \sum_{k=0}^{8} c_{16+k} \sin[\pi n(16+k)/32] \qquad \text{Eq. 13} \\ &= \sum_{k=0}^{8} c_{16+k} (\sin \pi n/2 \cos \pi nk/32 + \cos \pi n/2 \sin \pi nk/32) \end{aligned}$$

The trigonometric sinusoid terms sin n/2 and cos n/2 appearing in Eq. 12 and Eq. 13 serve the dual function of selecting either a cosine or sine trigonometric function value as well as to provide an algebraic sign for the corresponding selection. The following abbreviated Table 1 indicates both the selection and sign choice associated with each word number n of the master data set.

TABLE 1

| n | sin n/2 | cos n/2 |
|---|---|---|
| 1 | 1 | 0 |
| 2 | 0 | −1 |
| 3 | −1 | 0 |
| 4 | 0 | 1 |
| 5 | 1 | 0 |
| 6 | 0 | −1 |
| 7 | −1 | 0 |
| 8 | 0 | 1 |
| 9 | 1 | 0 |

n is the count state of the word counter 20. It will be shown below that the two least significant bits of the binary state of the word counter 19 are sufficient to implement these selection terms that occur in Eq. 12 and Eq. 13.

The sinusoid table 24 stores values of the trigonometric sinusoid function sin $2\pi y/64$ and the sinusoid table 124 stores the values of the trigonometric sinusoid function cos $2\pi y/64$. Values are read out simultaneously from both sinusoid tables in response to the content of the accumulator contained in the adder-accumulator 21.

The third coefficient memory 326 stores the harmonic coefficients corresponding to the harmonic number sequence 8,9, . . . , 16. These correspond to the harmonic coefficients used to compute $F_n$ according to Eq. 12.

The fourth coefficient memory 226 stores the harmonic coefficients corresponding to the harmonic number sequence 16,17, . . . , 24. These correspond to the harmonic coefficients used to compute $G_n$ according to Eq. 13.

Figure 6:
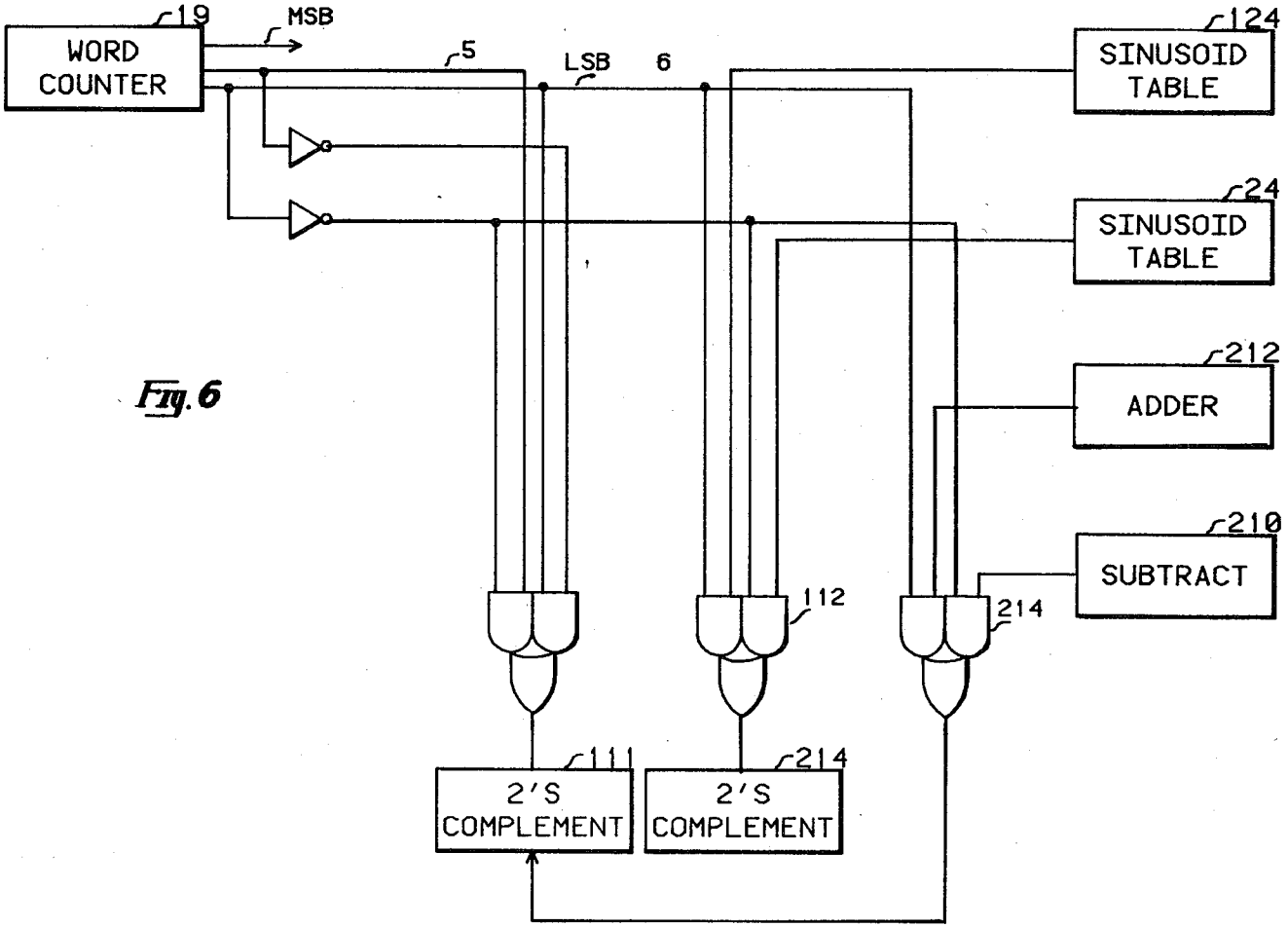
FIG. 6 is a schematic diagram of an alternate embodiment employing harmonic decomposition.

The adder 212 sums the harmonic coefficients read out of the third coefficient memory 326 and the fourth coefficient memory 226 and the subtract 210 computes the difference of the same harmonic coefficients. The data select 214 selects the sum value from the adder 212 at the same time that the function select 112 selects the cosine trigonometric values read out from the sinusoid table 124. The details of the select logic are shown in FIG. 6 and described below. The data select 214 will select the output value from the subtract 210 at the same time that the function select 112 selects the sine values read out from the sinusoid table 24. The 2's complement 111 will perform a 2's complement operation on the data chosen by the data select 214 according to the count state n of the word counter 19 as indicated in Table 1. The operation control logic for the 2's complement 111 is shown in FIG. 6 and described later.

The trigonometric function chosen by the function select 112 is multiplied by the output data value from the 2's complement 111 by means of the multiplier 128.

The adder 133 sums the product values produced by the multiplier 28 and the multiplier 128 and the summed value is provided as one input to adder 33. The adder 33 and the main register 34 function in the manner previously described for the same system components that appear in the system shown in FIG. 1.

Because of the overlap in the harmonic coefficient that appear in the decomposition form of Eq. 6, the end point harmonic coefficients can be stored with one-half of their value in each of the two harmonic memories in the fashion which has been previously described.

FIG. 6 shows the logic contained in the function select 112, 2's complement 214, and the data select 214. If bit 6, the LSB, of the binary count state of the word counter 19 is a binary state "0", then the select gate 112 will transfer the sine function read out of the sinusoid table to the multiplier 128 and the select gate 214 will transfer the output of the subtract 210 to the 2's complement 111. If bit 6 is a binary "1" then the select gate 112 will transfer the cosine function read out of the sinusoid table 124 to the multiplier 128 and the select gate 214 will transfer the output of the adder 212 to the 2's complement 111.

The operation of the control logic can be found by an examination of the abbreviated entries in Table 1 and the bits for the successive count states of the word counter 19. Table 2 lists an abbreviation of the various successive count states of the word counter 19.

TABLE 2

| n-count state | |
|---|---|
| decimal | binary |
| 1 | 000000 |
| 2 | 000001 |
| 3 | 000010 |
| 4 | 000011 |
| 5 | 000100 |
| 6 | 000101 |
| 6 | 000101 |
| 7 | 000110 |
| 8 | 000111 |
| 9 | 001000 |
| 10 | 001001 |
| 11 | 001010 |
| 12 | 001011 |
| 13 | 001100 |
| 14 | 001101 |
| 15 | 001110 |
| 16 | 011111 |

An examination of the binary states shown in Table 2 with the selection states shown in Table 1 indicates that a 2's complement operation should be performed if bit 6 (LSB) is a "0" (sine term selection) and bit 5 is a "1". Also a 2's complement operation should be performed if bit 6 is a "1" (cosine term selected) and bit 5 is a "0". This logic is implemented in FIG. 6.

Following the same reasons as previously discussed in connection with the operation of the system shown in FIG. 1, fractional addressing can be used for two sinusoid tables to obtain a non-zero Fourier component corresponding to the harmonic number 32.

Analaogous decomposition formulations can be written and implemented for the case in which the master data set points $z_n$ are computed with an even symmetry.

I claim:

1. In combination with a musical instrument in which a plurality of data words corresponding to the amplitudes of points defining the waveform of a musical tone are computed during each one of a sequence of computation cycles from a preselected set of harmonic coefficients and are transferred sequentially to a means for conversion into audible musical tones, apparatus for reducing the length of time required for each computation cycle by combining subsets of said preselected set of harmonic coefficients comprising:

a first harmonic coefficient memory for storing a first subset of said preselected harmonic coefficients, a second harmonic coefficient memory for storing a second subset of said preselected harmonic coefficients, a memory addressing means for reading out harmonic coefficients stored in said first harmonic coefficient memory and for reading out harmonic coefficients stored in said second harmonic coefficient memory, a waveshape memory means, a word counter means for generating a sequence of word numbers having alternate even and odd numerical values, a complementing means responsive to said sequence of word numbers and responsive to harmonic coefficients read out of said second harmonic coefficient memory whereby a harmonic coefficient is transformed to a corresponding harmonic coefficient having an opposite algebraic sign if a corresponding word number has an odd numerical value and whereby a harmonic coefficient is unaltered if said corresponding word number has an even numerical value, a summing means for combining a harmonic coefficient from said complementing means with a harmonic coefficient read out from said first harmonic coefficient memory to form a combined harmonic coefficient, a means for computing responsive to each of said combined harmonic coefficient and responsive to said sequence of word numbers whereby said plurality of data words corresponding to the amplitude of points defining the waveform of a musical tone are computed during each one of said sequence of computation cycles and stored in said waveshape memory means, and a means for producing audible musical tone responsive to data words stored in said waveshape memory means.

2. Apparatus according to claim 1 wherein said word counter means comprises;

a clock for providing timing signals, and a counter means for counting said timing signals modulo the number of memory addresses in said waveshape memory means.

3. Apparatus according to claim 2 wherein said means for computing comprises;

a harmonic counter incremented each time said counter means returns to its minimal count state and wherein said harmonic counter counts modulo a number which is the maximum of the number of harmonic coefficients in said first subset of harmonic coefficients or the number of harmonic coefficients in said second subset of harmonic coefficients and said maximum number is less than the number of harmonic coefficients in said preselected set of harmonic coefficients, an adder-accumulator means wherein the count state of said harmonic counter is successively added to the contents of an accumulator in response to said timing signals, a sinusoid table for storing a plurality of trigonometric sinusoid values, an address decoder means responsive to the content of said accumulator in said adder-accumulator means for reading out trigonometric sinusoid values from said sinusoid table, a data computing means responsive to trigonometric values read out from said sinusoid table and responsive to each said combined harmonic coefficient whereby said plurality of data words corresponding to the amplitudes of points defining the waveform of a musical tone are computed during each one of said sequence of computation cycles, and a waveshape addressing means responsive to the count state of said counter means whereby said plurality of data words computed by said data computing means are stored in said waveshape memory means.

4. Apparatus according to claim 3 wherein said memory addressing means comprises;

a memory address decoding means whereby harmonic coefficients stored in said first harmonic coefficient memory are read out in response to the contents of said harmonic counter and whereby harmonic coefficients stored in said second harmonic coefficient memory are read out in response to the contents of said harmonic counter.

5. Apparatus according to claim 1 wherein said first harmonic coefficient memory stores said first subset of preselected harmonic coefficients in memory address locations that increase in number from one to the maximum number of memory address locations and wherein said second harmonic coefficient memory stores said second subset of preselected harmonic coefficients in memory locations that decrease in number from the maximum number of memory address locations to one.

6. Apparatus according to claim 1 wherein said preselected set of harmonic coefficients correspond to the harmonic number sequence $q=1,2, \ldots, N$ where N is the maximum number of harmonics and wherein said first harmonic coefficient memory stores a first subset of said preselected harmonic coefficients at memory address locations corresponding to a harmonic number sequence $q=1,2, \ldots, N/2$ and wherein said second harmonic coefficient memory stores a second subset of preselected harmonic coefficients at memory locations corresponding to said harmonic number sequence and wherein the harmonic coefficient for the harmonic number $N-q$ is stored at a memory location corresponding to the harmonic coefficient associated with the harmonic number q.

7. Apparatus according to claim 1 wherein said complementing means comprises a 2's complementing logic whereby in response to said word number having an even numerical value a 2's complement logic operation is performed on said corresponding harmonic coefficient expressed in its binary numerical form.

8. In combination with a musical instrument in which a plurality of data words corresponding to the amplitudes of points defining the waveform of a musical tone are computed from a preselected set of harmonic coefficients at regular time intervals and converted into musical tones, apparatus for reducing the length of time required to compute each one of said data words by combining subsets of said preselected set of harmonic coefficients comprising;

a first harmonic coefficient memory for storing a first subset of said preselected harmonic coefficients, a second harmonic coefficient memory for storing a second subset of said preselected harmonic coefficients, a memory addressing means for reading out harmonic coefficients stored in said first harmonic coefficient memory and for reading out harmonic coefficients stored in said second harmonic coefficient memory, a counter means for generating a sequence of word numbers having alternate even and odd numerical values, a complementing means responsive to said sequence of word numbers whereby a harmonic coefficient read out of said second harmonic coefficient memory is transformed to its opposite algebraic sign if a corresponding word number has an even numerical value and whereby said harmonic coefficient is unaltered in algebraic sign if said corresponding word number has an odd numerical value, a summing means for combining a harmonic coefficient from said complementing means with a harmonic coefficient read out from said first harmonic coefficient memory to form a combined harmonic coefficient, a means for computing responsive to each said combined harmonic coefficient and responsive to said sequence of word numbers whereby said plurality of data words corresponding to the said amplitudes of points defining the waveform of a musical tone are computed, and a means for producing a musical tone from said plurality of data words.

9. Apparatus according to claim 8 wherein said counter means comprises;

a means for obtaining a frequency number, and a note interval adder wherein said frequency number is successively added to the sum previously contained in said note interval adder and whereby the most significant bits of said sum in binary numerical format generate said sequence of word numbers having alternate even and odd numerical values.

10. Apparatus according to claim 9 wherein said means for computing comprises;

a harmonic interval adder cleared to a zero value before a computation of each one of said plurality of data words wherein the content of said note interval adder is added to the present content of said harmonic interval adder, a sinusoid table for storing a plurality of trigonometric sinusoid values, a table memory addressing means for reading trigonometric sinusoid values from said sinusoid table in response to the content of said harmonic interval adder, and a data computing means responsive to trigonometric values read out of said sinusoid table and responsive to each said combined harmonic coefficient whereby said plurality of data words defining the waveform of a musical tone are computed.

11. Apparatus according to claim 8 wherein said first harmonic coefficient memory stores said first subset of preselected harmonic coefficients in memory address locations that increase in number from one to the maximum number of memory address locations and wherein said second harmonic coefficient memory stores said second subset of preselected harmonic coefficients in memory locations that decrease in number from the maximum number of memory address locations to one.

12. Apparatus according to claim 8 wherein said preselected set of harmonic coefficients correspond to the harmonic number sequence $q=1,2,\ldots,N$ where N is the maximum number of harmonics, and wherein said first harmonic coefficient memory stores a first subset of said preselected harmonic coefficients at memory address locations corresponding to a harmonic number sequence $q=1,2,\ldots,N/2$ and wherein said second harmonic coefficient memory stores a second subset of preselected harmonic coefficients at memory locations corresponding to said harmonic number sequence and wherein the harmonic coefficient for the harmonic number $N-q$ is stored at a memory location corresponding to the harmonic coefficient associated with the harmonic number q.

13. Apparatus according to claim 8 wherein said complementing means comprises a 2's complementing logic whereby in response to said word number having an even numerical value a 2's complement logic operation is performed on said corresponding harmonic coefficient expressed in its binary numerical form.

14. In combination with a musical instrument in which a plurality of data words corresponding to the amplitude of points defining the waveform of a musical tone are computed during each one of a sequence of computation cycles from a preselected set of harmonic coefficients and are transferred sequentially to a means for conversion into audible musical tones, apparatus for reducing the length of time required for each computation cycle by combining subsets of said preselected set of harmonic coefficients comprising;

a first harmonic coefficient memory for storing a first subset of said preselected harmonic coefficients, a second harmonic coefficient memory for storing a second subset of said preselected harmonic coefficients, a third harmonic coefficient memory for storing a third subset of said preselected harmonic coefficients, a fourth harmonic coefficient memory for storing a fourth subset of said preselected harmonic coefficients, a memory addressing means for reading out harmonic coefficients stored in said first, second, third, and fourth harmonic coefficient memories, a waveshape memory means, a first coefficient combining means whereby a harmonic coefficient read out from said first harmonic coefficient memory is combined with a harmonic coefficient read out from said second harmonic coefficient memory to form a first combined harmonic coefficient, a second coefficient combining means whereby a harmonic coefficient read out from said third harmonic coefficient memory is combined with a harmonic coefficient read out from said fourth harmonic coefficient memory to form a second combined harmonic coefficient, a first means for computing responsive to each of said first combined harmonic coefficient whereby a first component plurality of data words are computed during each one of said sequence of computation cycles, a second means for computing responsive to each said second combined harmonic coefficient whereby a second component plurality of data words are computed during each one of said sequence of computation cycles, a combining means whereby said first component plurality of data words are combined with said second plurality of data words to form said plurality of data words corresponding to the amplitudes of points defining the waveform of a musical tone and are stored in said waveshape memory means, and a means for producing a musical tone responsive to data words stored in said waveshape memory means.

15. Apparatus according to claim 14 wherein said first coefficient combining means comprises;

a clock for providing timing signals, and a word counter means for counting said timing signals modulo the number of memory addresses in said waveshape memory means whereby a sequence of word numbers is generated having alternate even and odd numerical values.

16. Apparatus according to claim 15 wherein said first coefficient combining means comprises;

a complementing means responsive to said sequence of word numbers whereby a harmonic coefficient read out from said second harmonic coefficient memory is transformed to its opposite algebraic sign if a corresponding word number has an even numerical value and whereby said harmonic coefficient is unaltered in algebraic sign if said corresponding word number has an odd numerical value, and a summing means for combining a harmonic coefficient from said complementing means with a harmonic coefficient read out from said first harmonic coefficient memory to form a first combined harmonic coefficient.

17. Apparatus according to claim 15 wherein said second coefficient combining means comprises;

a data select means whereby a harmonic coefficient read out from said fourth harmonic coefficient memory is subtracted from a harmonic coefficient read out from said third harmonic coefficient memory in response to an even numerical value for a corresponding word number to form a component harmonic coefficient and whereby a harmonic coefficient read out from said fourth harmonic coefficient is added to a harmonic coefficient read out from said third harmonic coefficient memory in response to an odd numerical value for said corresponding word number to form said component harmonic coefficient, and a complementing means responsive to said sequence of word numbers whereby said component harmonic coefficient is transformed to its opposite algebraic sign if a corresponding word number has an even numerical value and whereby said component harmonic coefficient is unaltered in algebraic sign if said corresponding word number has an odd numerical value.

18. Apparatus according to claim 15 wherein said first means for computing comprises;

a harmonic counter incremented each time said word counter means returns to its minimal count state and wherein said harmonic counter counts modulo a number which is less than the number of harmonic coefficients in said preselected set of harmonic coefficients, an adder-accumulator means wherein the count state of said harmonic counter is successively added to the contents of an accumulator in response to said timing signals, a first sinusoid table for storing a plurality of trigonometric sine function values, an address decoder means responsive to the content of said accumulator in said adder-accumulator means for reading out trigonometric sine function values from said first sinusoid table, and a first data computing means responsive to trigonometric sine values read out from said first sinusoid table and responsive to each said first combined harmonic coefficient whereby said first component plurality of data words are computed during each one of said sequence of computation cycles.

19. Apparatus according to claim 18 wherein said second means for computing comprises;

a second sinusoid table for storing a plurality of trigonometric cosine function values, a table addressing means whereby a trigonometric cosine value is read out from second sinusoid table in response to the content of said accumulator in said adder-accumulator, a function select means whereby said trigonometric sine value read out from said first sinusoid table is selected if said corresponding word number has an even numerical value and whereby said trigonometric cosine value read out from said second sinusoid table is selected if said corresponding word number has an odd numerical value, and a second data computing means responsive to the trigonometric value selected by said function select means and responsive to each said second combined harmonic coefficient whereby said second component plurality of data words are computed during each one of said sequence of computation cycles.

20. Apparatus according to claim 15 wherein said combining means comprises;

an adder for pointwise summing corresponding values of said first component plurality of data words and values of said second component plurality of data words to form said plurality of data words corresponding to the amplitudes of points defining the waveform of a musical tone, and a waveshape addressing means responsive to the content of said word counter means whereby said plurality of data words are stored in said waveshape memory means.

* * * * *